US006560909B2

(12) United States Patent
Cominolli

(10) Patent No.: US 6,560,909 B2
(45) Date of Patent: May 13, 2003

(54) MANUAL SAFETY FOR LINEAR STRIKER FIRED SEMI-AUTOMATIC OR AUTOMATIC PISTOLS

(76) Inventor: Joseph Cominolli, 624 Cherry Rd., Syracuse, NY (US) 13219

( * ) Notice: Subject to any disclaimer, the term of this patent is extended or adjusted under 35 U.S.C. 154(b) by 21 days.

(21) Appl. No.: 09/886,112

(22) Filed: Jun. 22, 2001

(65) Prior Publication Data

US 2002/0194762 A1 Dec. 26, 2002

(51) Int. Cl.[7] ..... F41A 17/00
(52) U.S. Cl. ..... 42/70.05; 42/70.06; 89/148
(58) Field of Search ..... 89/27.12, 148, 89/150; 42/70.06, 70.04–70.05

(56) References Cited

U.S. PATENT DOCUMENTS

| | | | | | |
|---|---|---|---|---|---|
| 816,591 | A | * | 4/1906 | McClean | 42/18 |
| 1,041,648 | A | * | 10/1912 | Mauser | 42/70.06 |
| 1,294,506 | A | | 2/1919 | Martin | |
| 1,896,820 | A | * | 2/1933 | Jolidon | 42/1.01 |
| 2,115,041 | A | * | 4/1938 | Obregon | 42/70.02 |
| 2,711,043 | A | | 6/1955 | Bent, Jr. | 42/70 |
| 3,128,570 | A | * | 4/1964 | Browning | 42/70.01 |
| 3,713,242 | A | * | 1/1973 | Seifried | 42/70.06 |
| 3,757,634 | A | * | 9/1973 | Uria et al. | 42/70.08 |
| 3,857,325 | A | * | 12/1974 | Thomas | 42/70.02 |
| 4,002,101 | A | | 1/1977 | Tellie | 89/142 |
| 4,208,947 | A | | 6/1980 | Hillberg | 89/148 |
| 4,539,889 | A | * | 9/1985 | Glock | 89/147 |
| 4,697,495 | A | | 10/1987 | Beretta | 89/143 |
| 4,742,634 | A | | 5/1988 | Swenson | 42/70.01 |
| 4,825,744 | A | * | 5/1989 | Glock | 89/145 |
| 4,841,656 | A | * | 6/1989 | Brandt | 42/70.01 |
| 4,893,546 | A | * | 1/1990 | Glock | 89/145 |
| 5,000,076 | A | | 3/1991 | David | 89/148 |
| 5,025,582 | A | * | 6/1991 | Mote, Sr. | 42/70.06 |
| 5,042,185 | A | | 8/1991 | Justice, Sr. | 42/70.11 |
| 5,088,222 | A | | 2/1992 | Larson | 42/70.04 |
| 5,090,147 | A | | 2/1992 | Pastor | 42/70.05 |
| 5,157,209 | A | | 10/1992 | Dunn | 42/70.08 |
| 5,303,494 | A | | 4/1994 | Tuma et al. | 42/70.04 |
| 5,355,768 | A | | 10/1994 | Felk | 89/147 |
| 5,402,593 | A | | 4/1995 | Lenkarski et al. | 42/70.06 |
| 5,465,517 | A | | 11/1995 | Garofalo | 42/70.06 |
| 5,513,460 | A | | 5/1996 | Van Niekerk et al. | 42/70.06 |
| 5,649,383 | A | * | 7/1997 | Wesp et al. | 42/44 |
| 5,697,178 | A | | 12/1997 | Haskell | 42/70.04 |
| 5,705,763 | A | * | 1/1998 | Leon | 89/128 |
| 5,752,338 | A | | 5/1998 | Lameiras Guede | 42/70.06 |
| 6,018,900 | A | | 2/2000 | Guede | 42/70.06 |
| 6,308,448 | B1 | * | 10/2001 | Kapusta et al. | 42/69.02 |

FOREIGN PATENT DOCUMENTS

| | | |
|---|---|---|
| IT | 253139 | * 12/1926 |

* cited by examiner

*Primary Examiner*—Michael J. Carone
*Assistant Examiner*—Denise J Buckley
(74) *Attorney, Agent, or Firm*—George R. McGuire; Hancock & Estabrook, LLP

(57) ABSTRACT

A manual safety system for reducing the chances of inadvertent discharge of a linear striker fired semi-automatic or automatic pistol equipped with the system. An otherwise conventional pistol is modified by structural changes in the trigger mechanism housing and by the addition of a trigger bar guide, a manually movable safety lever, a pressure plate and a spring. The trigger bar guide and safety lever are mounted to the trigger mechanism housing for linear and pivotal movement, respectively. A portion of the conventional trigger bar, which must be moved in order to effect firing movement of the trigger, is engaged with and blocked by the trigger bar guide which in turn is engaged and blocked by a portion of the safety lever. In order to unblock and enable the firing system, the safety lever is moved by applying pressure to a tab serving as a thumb rest. Rotation of the safety lever disengages it from the trigger bar guide, permitting rearward movement of the guide and the trigger bar and firing movement of the trigger.

16 Claims, 9 Drawing Sheets

(4X)

(4X)

FIG. 25
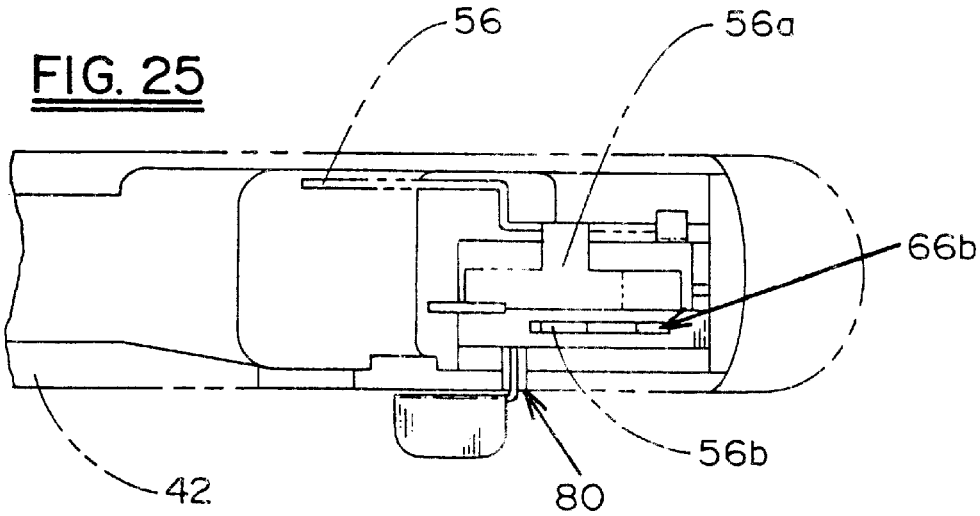
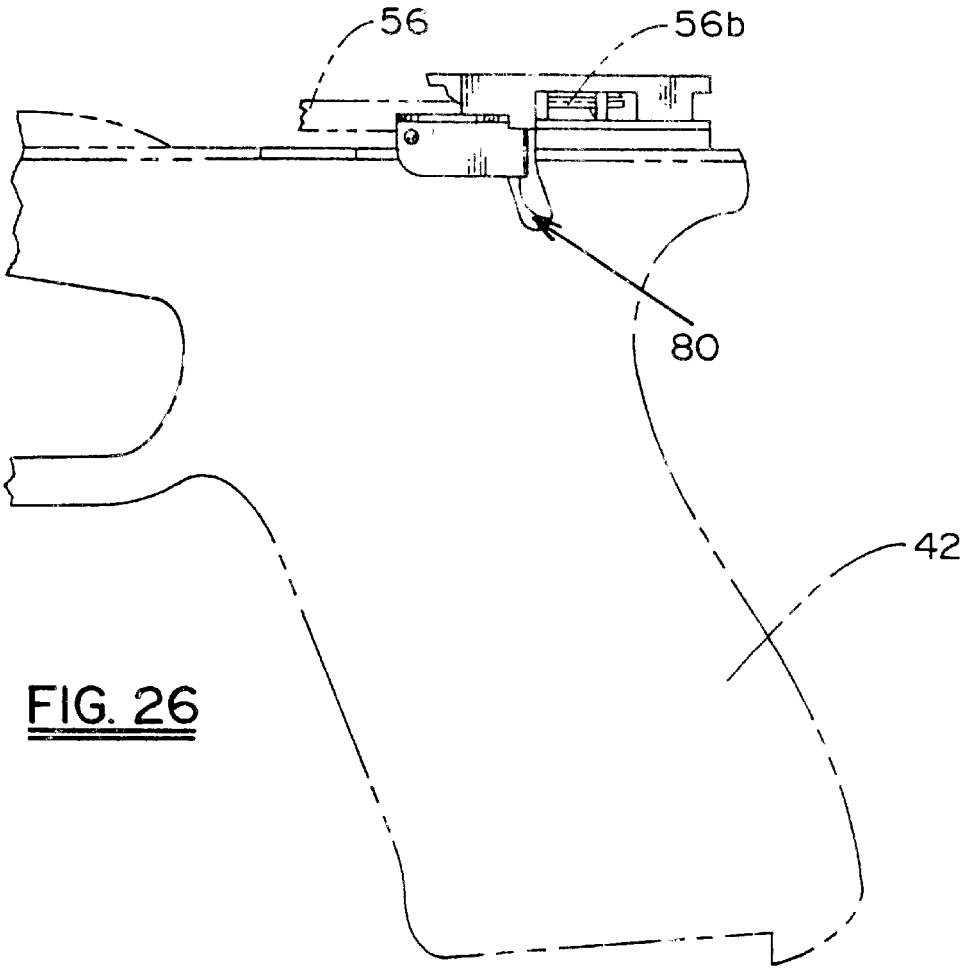
FIG. 26

MANUAL SAFETY FOR LINEAR STRIKER FIRED SEMI-AUTOMATIC OR AUTOMATIC PISTOLS

BACKGROUND OF THE INVENTION

The present invention relates to manually released safety locking devices for pistols and, more specifically, to manually operated locking devices incorporated in certain, otherwise conventional semi-automatic or automatic pistols to prevent firing movement of the trigger until the user disables the safety lock.

The prior art includes many examples of safety devices, both automatically and manually operated, to prevent or reduce the likelihood of inadvertent discharge of a chambered round. Such safety devices have been incorporated in commercially available handguns, including the class of pistols described as linear striker fired semi-automatic or automatic pistols. One such firearm, having both manually operated and automatic safety systems, is that disclosed in U.S. Pat. No. 5,157,209 of Dunn wherein, when the manual safety is in the safe position, the striker is blocked and the trigger bar is disengaged from the sear and the dislocator. However, some pistols of this type, notably those manufactured by Glock GmbH of Deutsch-Wagram, Austria, are structurally dissimilar to that shown in the Dunn patent (e.g., they do not include a sear) and thus not suitable for incorporation of such a manual safety.

The present invention is designed for incorporation in pistols, such as GLOCK type pistols, the principal object of the invention being to provide an effective lock for the entire fire control system which requires manual release by the user independently of trigger pull. Other objects are to provide, in a linear striker fired pistol, a manual safety device which: 1. operates independently of existing automatic safety devices, 2. prevents the firing pin from moving rearward or forward, 3. immobilizes the trigger bar, 4. provides additional leverage to reduce felt recoil, and 5. serves as an indicator that the user may have neglected to chamber a round of ammunition. Other objects and advantages of the invention will in part be obvious and will in part be apparent from the following detailed disclosure.

SUMMARY OF THE INVENTION

For convenience, the invention will be shown and described in connection with a conventional pistol known as a GLOCK pistol 17 from which other GLOCK pistol models differ only slightly in constructional details. Aside from the standard, unmodified parts of this pistol, the present invention incorporates a modified trigger mechanism housing and additional elements mounted thereon to provide the manual safety device. It is important to note that the elements providing the manual safety feature are mounted on the trigger mechanism housing and not on the frame of the pistol. The trigger mechanism housing is modified for mounting thereon of a manually movable lever having on one end a flat tab which is positioned near the handle to serve as a thumb rest for the operator during firing, with thumb pressure on the tab rotating the member about its pivotal connection at the other end to the trigger mechanism housing. The pistol frame is modified by adding a slot for passage of an intermediate portion between the thumb rest and the pivotal mounting ends of the manually movable lever. Other elements added by the present invention are a trigger bar guide, a pressure plate having a pair of detent openings, and a disc spring.

When the pistol is held in the usual manner preparatory to firing, with the index finger on the trigger and the other three fingers grasping the handle, the thumb is placed on the tab extending laterally outwardly from the left side at the top of the handle. Downward pressure applied by the thumb causes the member to rotate through a predetermined angle, thereby moving the safety lever out of blocking relation with respect to the trigger bar guide which is mounted for reciprocal, sliding movement on the trigger mechanism housing. A portion of the trigger bar engages the trigger bar guide, preventing rearward movement of the bar until the safety lever unblocks movement of the guide. Manual movement of the safety lever allows rearward movement of the trigger bar guide, permitting the trigger to be pulled and the pistol to be fired. Cooperable detent means on the safety lever and pressure plate define the "on" and "off" positions of the manual safety. The structure, interconnection and operation of the parts concerned with the present invention will be more readily understood and fully appreciated from the following detailed description, taken in conjunction with the accompanying drawings.

BRIEF DESCRIPTION OF THE DRAWINGS

FIGS. 25 and 26 are fragmentary, top plan and side elevational views, respectively, of the subassembly mounted upon the pistol, the handle of which is shown in phantom lines;

DETAILED DESCRIPTION

Figure 1:
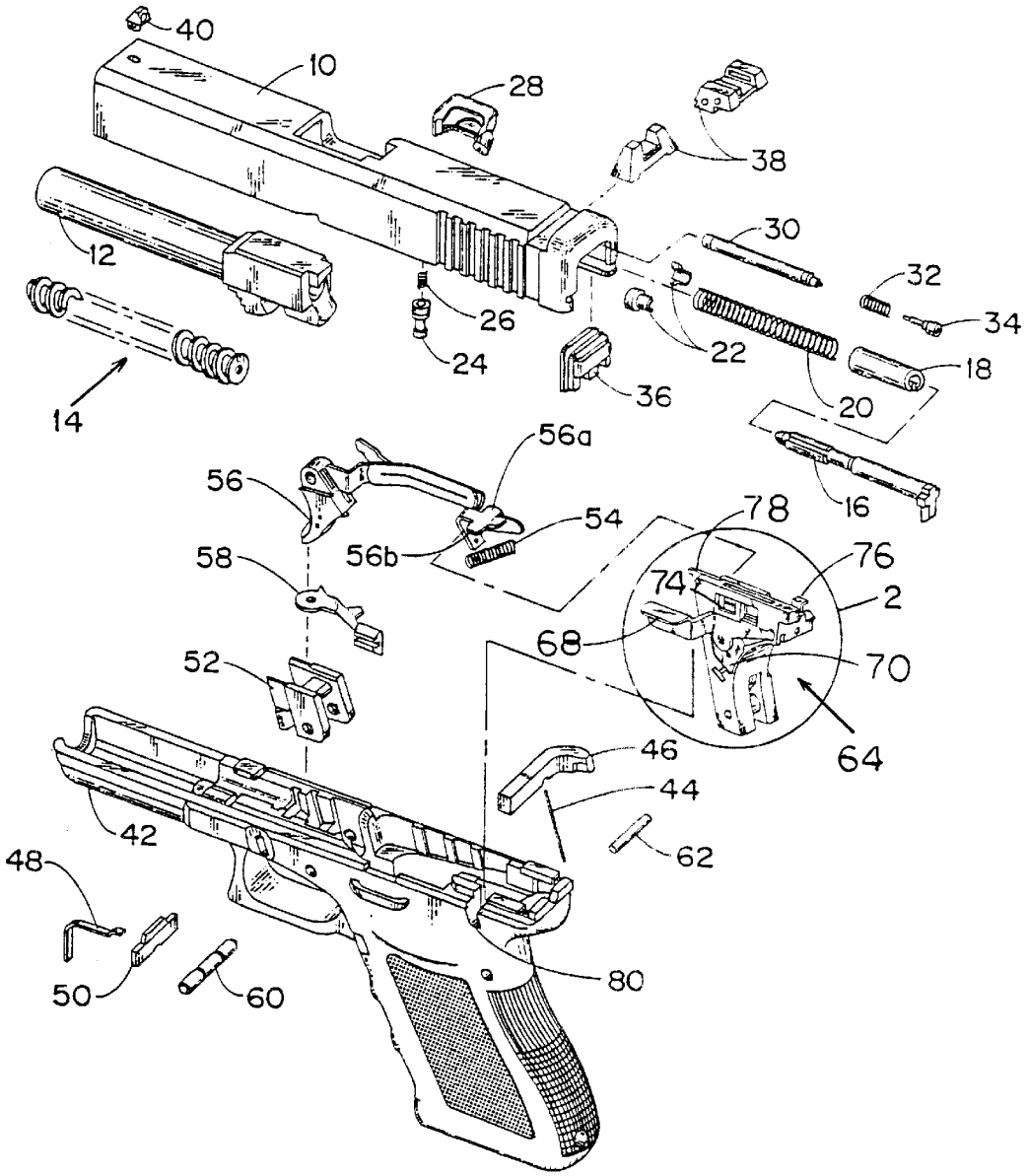
FIG. 1 is an exploded perspective view of a linear striker fired semi-automatic pistol including both conventional parts and parts both modified and added to provide the manual safety system of the present invention.

Referring now to the drawings, as previously mentioned, the invention is shown in FIG. 1 incorporated in an otherwise conventional pistol, more specifically, the previously mentioned GLOCK linear stiker fired (hammerless) pistol. Elements of the pistol include slide 10, barrel 12, recoil spring assembly 14, firing pin 16, spacer sleeve 18, firing pin spring 20, spring cups 22, firing pin safety 24, firing pin safety spring 26, extractor 28, extractor depressor plunger 30, extractor depressor plunger spring 32, spring-loaded bearing 34, slide cover plate 36, rear sight 38, front sight 40, receiver/frame 42, magazine catch spring 44, magazine catch 46, slide lock spring 48, slide lock 50, locking block 52, trigger spring 54, trigger 56 with attached trigger bar 56*a*, slide stop lever 58, trigger pin 60, and trigger housing pin 62. The magazine and elements associated therewith are not shown. All these parts, their manner of assembly, disassembly and operation are entirely conventional and well known in the art. It will be noted that the conventional trigger bar has a cruciform portion at its rear end including laterally extending leg 56*b*.

Figure 2:
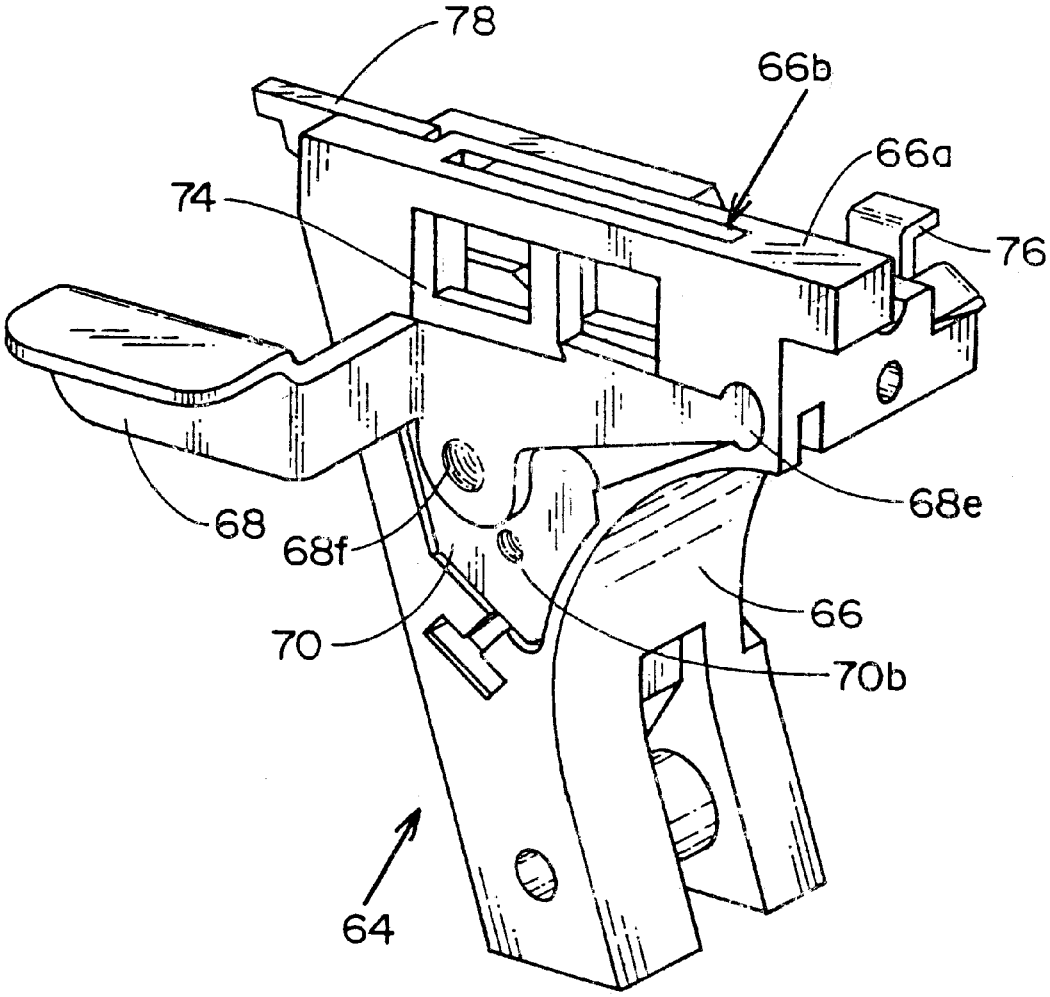
FIG. 2 is a perspective view of a subassembly of elements circled in FIG. 1 and designated with numeral "2"
Figure 3:
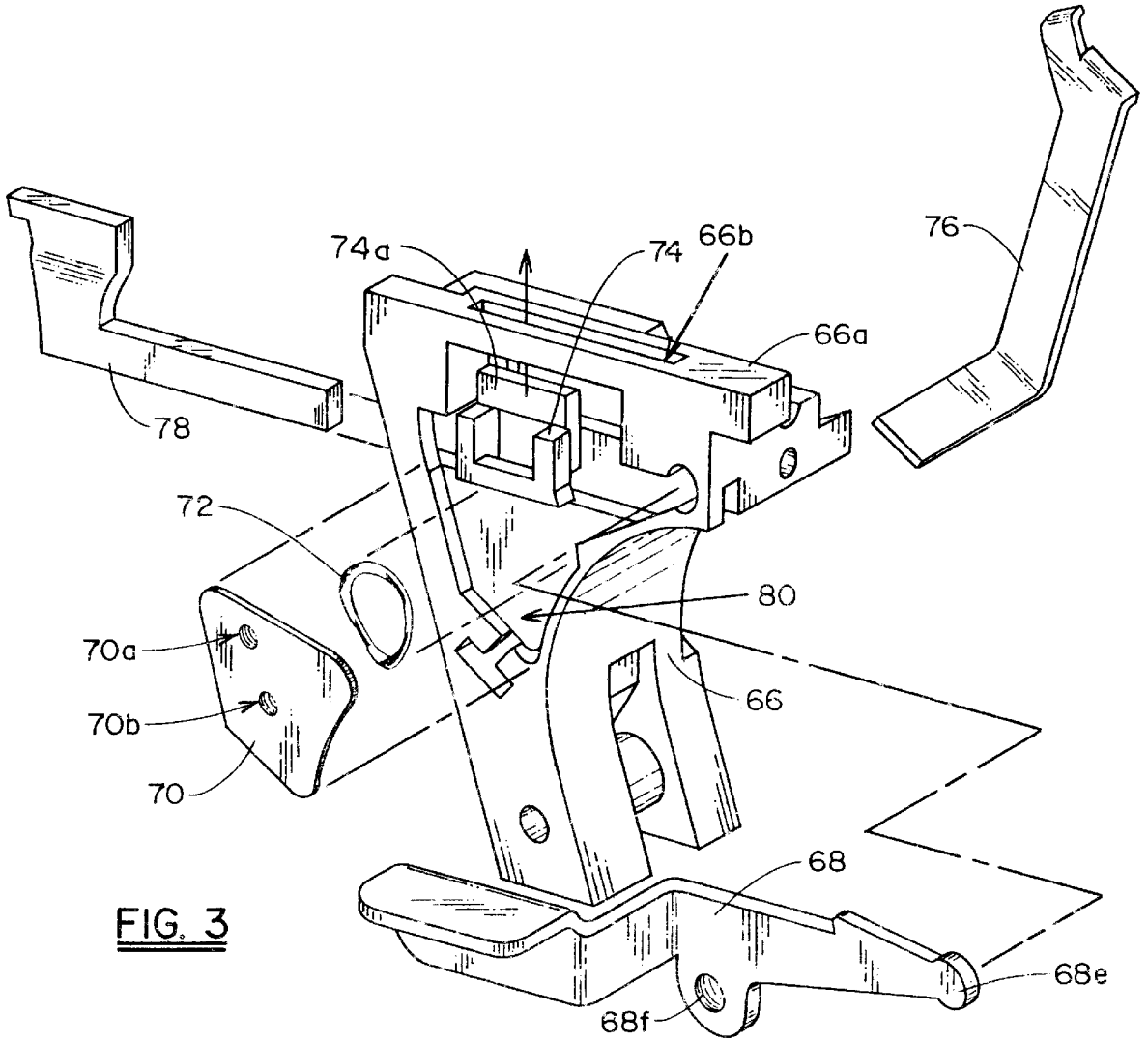
FIG. 3 is an exploded perspective view of the subassembly of FIG. 2.
Figure 4:
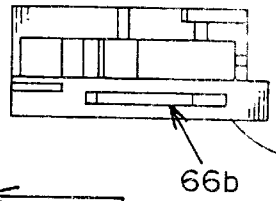
FIGS. 4 through 9 are top, front, left side, rear, bottom and right side views, respectively, of one of the elements of FIGS. 2 and 3.
Figure 5:
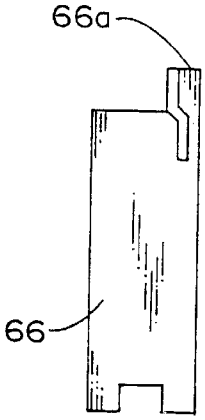
Figure 6:
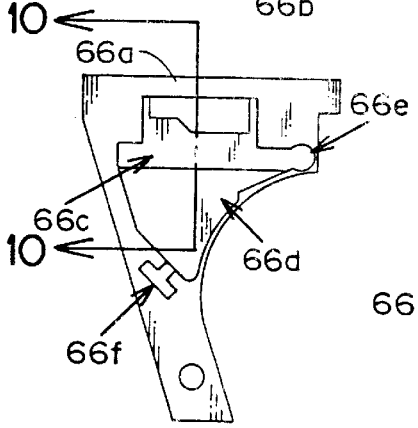
Figure 7:
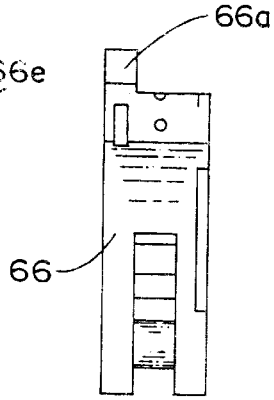
Figure 8:
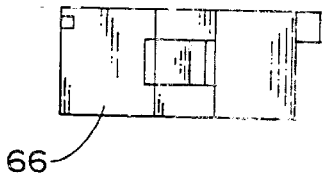
Figure 10:
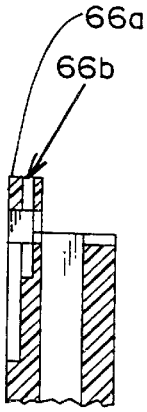
FIG. 10 is a rear elevational view in section on the line 10—10 of FIG. 6.
Figure 9:
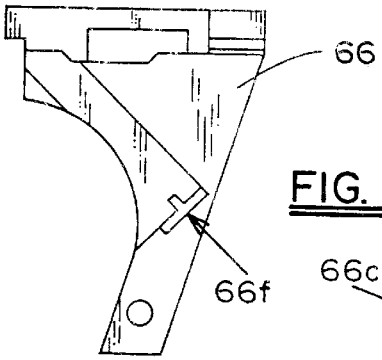
Figure 11:
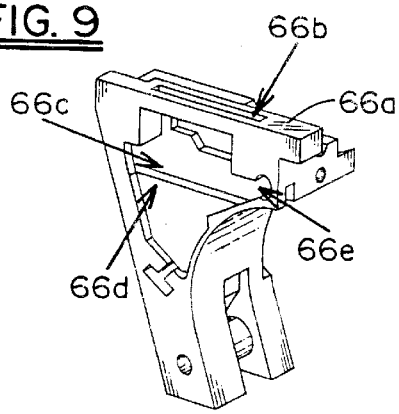
FIG. 11 is a perspective view of the element of FIGS. 4–10.
Figure 16:
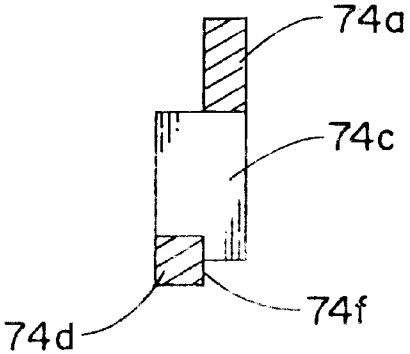
FIG. 16 is a side view in section on the line 16—16 of FIG. 14.
Figure 12:
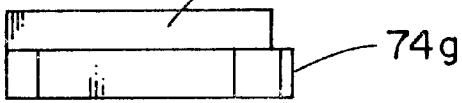
FIGS. 12 through 15 are top, side, front and bottom views, respectively, of another element of the subassembly of FIGS. 2 and 3.
Figure 14:
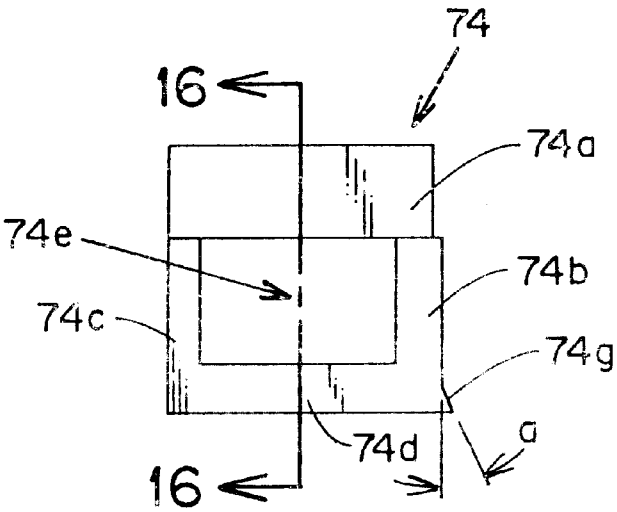
Figure 15:
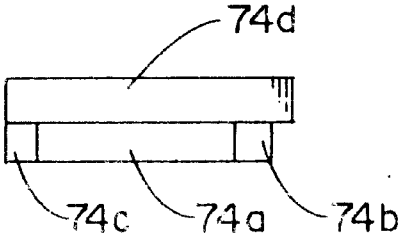
Figure 13:
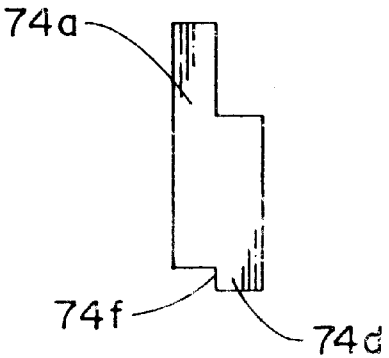
Figure 17:
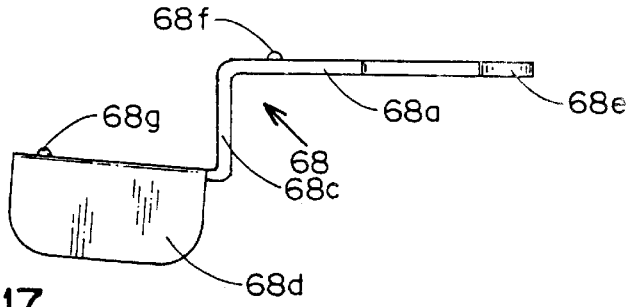
FIGS. 17 through 20 are top, side, bottom and rear views, respectively, of still another element of the subassembly of FIGS. 2 and 3.
Figure 18:
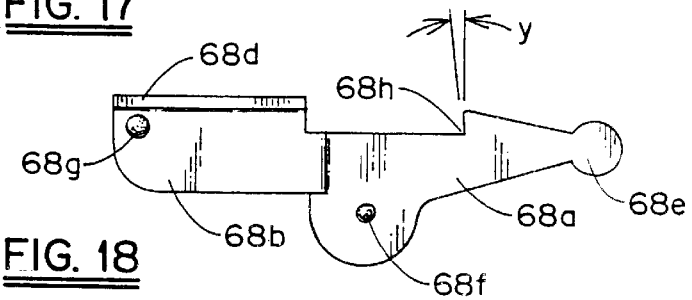
Figure 19:
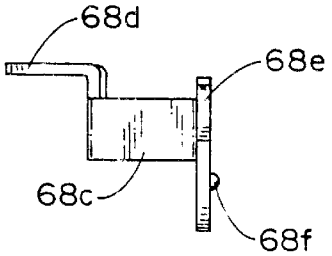
Figure 20:
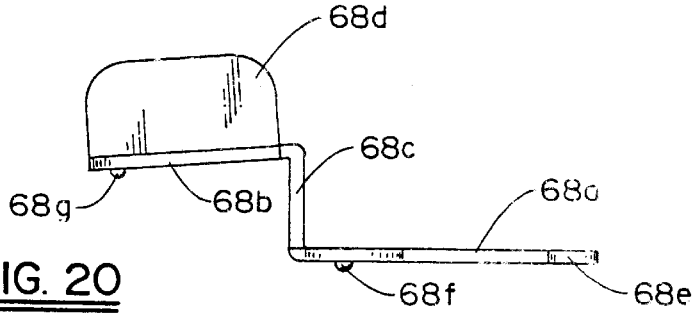

The subassembly within the circle denoted by numeral 2 in FIG. 1 is unique to the present invention and shown in more detail in FIGS. 2 and 3, to which reference is now made. The subassembly is denoted generally by reference numeral 64 and includes trigger mechanism housing 66, safety operating lever 68, pressure plate 70, circular disc spring 72, trigger bar guide 74, connector 76, and ejector 78. Trigger housing mechanism 66 is a structurally modified version of the trigger housing mechanism of conventional GLOCK pistols. Connector 76 and ejector 78 are conventional and unmodified from those of the GLOCK pistol. Lever 68, plate 70, spring 72 and trigger bar guide 74 are elements unique to the present invention.

Details of construction of trigger mechanism housing 66 are seen in FIGS. 4–11. Basically, housing 66 has been modified from the corresponding element in the conventional pistol for mounting thereon of the elements of the manual safety device of the invention. One significant modification is the addition of upper extension 66*a* having open slot 66*b* therein. Another modification is a recess in the left side of housing 66, i.e., the side which is on the user's left when the pistol is held in the firing position. This recess includes upper portion 66*c* and somewhat deeper, lower portion 66*d*. Portion 66*c* has at its rear end circular portion 66*e* having a periphery of somewhat more than 180 degrees. T-shaped slot 66*f* appears identically in the conventional version of housing 66 for attachment of conventional connector 76 (FIG. 3).

Details of trigger bar guide 74 are shown in FIGS. 12–16. This element is in the form of a four-sided frame, having upper flange portion 74*a*, sides 74*b* and 74*c*, and lower portion 74*d*, surrounding open center 74*e*. Shoulder 74*f* is formed by one edge of lower portion 74*d*, providing an abutment surface for ejector 78 in the assembled condition of the elements. Small, wedge-shaped protrusion 74*g* extends outwardly at acute angle x to the edge of side 74*b* for purposes described later.

Referring now to FIGS. 17–20, the configuration of manual safety lever 68 (i.e., manually movable member) is shown. Lever 68 is formed from a sheet metal stamping, bent to the desired shape. Base portion 68*a* and offset portion 68*b* are joined by intermediate portion 68*c* at 90 degree bends so that portions 68*a* and 68*b* lie in spaced, parallel planes. Tab 68*d* extends outwardly from offset portion 68*b*. Circular portion 68*e* at the end of base portion 68*a* remote from the end joined to intermediate portion 68*c* has a periphery complementary to that of portion 66*e* of the recess' upper portion 66*c* in trigger mechanism housing 66. Embossed areas 68*f* and 68*g* are formed in base portion 68*a* and offset portion 68*b*, respectively, providing a small protrusion on one side and indentation on the other side of each portion, the purposes of which are explained later. Shoulder 68*h* is formed in the upper edge of base portion 68*a*, preferably extending forwardly at an acute angle "y" with respect to the perpendicular to the upper edge.

Figure 21:
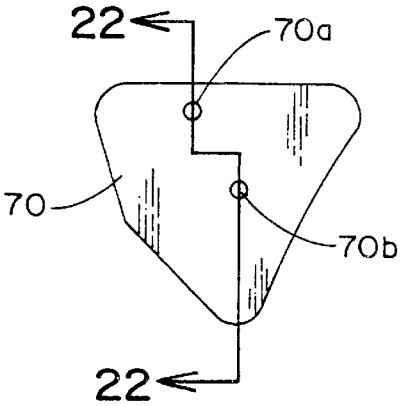
FIG. 21 is a front elevational view of another element of the subassembly.
Figure 22:
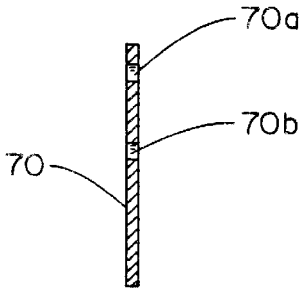
FIG. 22 is a sectional view on the line 22—22 of FIG. 21.
Figure 23:
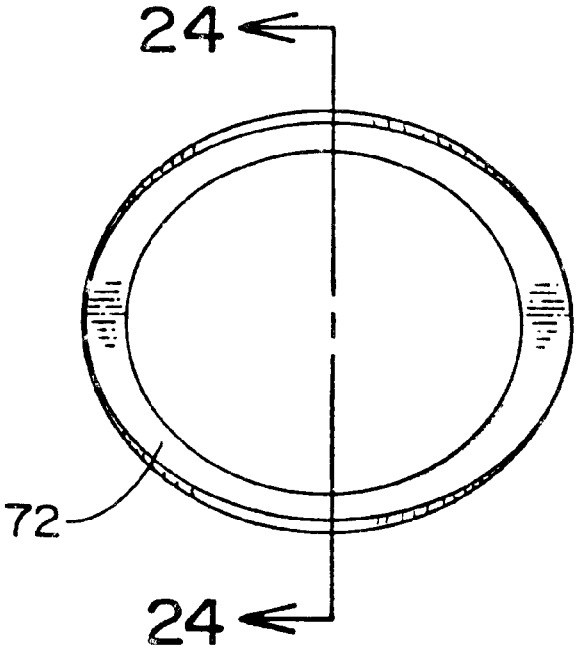
FIG. 23 is a front elevational view of another element of the subassembly.
Figure 24:
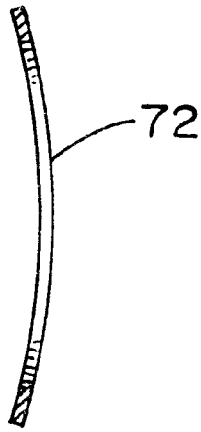
FIG. 24 is a sectional view on the line 24—24 of FIG. 23.

The peripheral outline of pressure plate 70 is shown in FIG. 21, being substantially complementary to the outline of lower part 66*d* of the recess in trigger mechanism housing 66. A pair of small openings 70*a* and 70*b* are formed at spaced locations on plate 70 for purposes described later. Disc spring 72 is shown separately in FIGS. 23 and 24.

The elements forming subassembly 64 are placed in cooperative relation upon housing 66 by inserting trigger bar guide 74 into the upper, partially enclosed part of the housing with flange portion 74*a* in open slot 66*b* and inserting the lower leg of ejector 78 from front to rear, against shoulder 74*f* of trigger bar guide 74, to lie within upper portion 66*c* of the recess in the side of housing 66. This is followed by placing spring 72 against the wall forming the base of the lower part 66*d* of the recess, placing plate 70 in covering relation to spring 72 with the periphery of plate 70 fitting loosely within the outline of lower portion 66*d* of the recess, and placing base portion 68*a* of manual safety lever 68 in partially covering relation to plate 70 with circular portion 68*e* fitting snugly within circular recess portion 66*e*. Connector 76 is mounted upon housing 66 in the same manner as in a conventional pistol with the lower end of the connector engaged in slot 66*f*.

Figure 27:
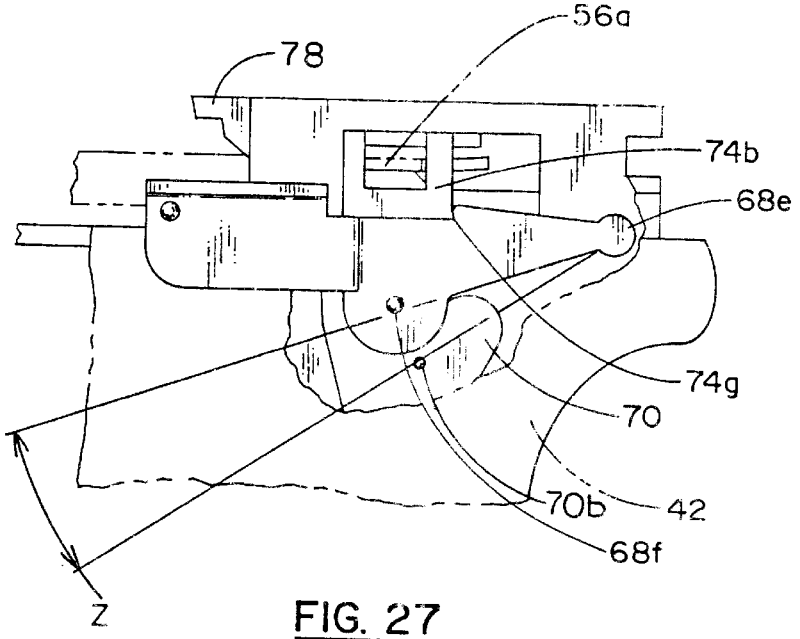
FIGS. 27 and 28 are side elevational views of the subassembly, with the handle of the pistol shown in phantom lines, in operative (locked) and inoperative (unlocked) positions, respectively, of the safety mechanism.
Figure 28:
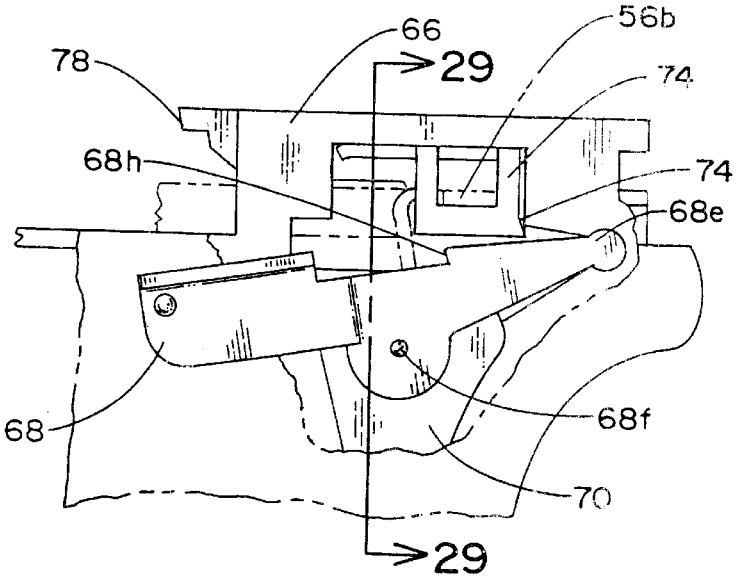
Figure 29:
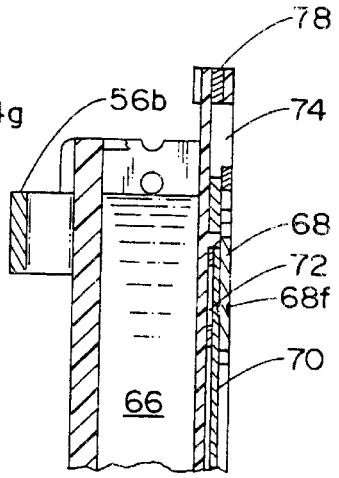
FIG. 29 is a cross-sectional view taken along lines 29—29 of FIG. 28.

When subassembly 64 is mounted upon the pistol frame 42, as shown in FIGS. 25–28, tab 68*d* extends outwardly from the left side adjacent the upper, rear end of the handle. Intermediate portion 68*c* extends through notch 80 which is formed in the frame as an additional modification to the conventional pistol. Dimensions of the elements, notably trigger mechanism housing 66, manual safety lever 68, pressure plate 70 and spring 72, are so related to the cavity within the pistol frame in which subassembly 64 is mounted that base portion 68*a* is firmly engaged between plate 70 and the inside surface of the pistol and spring 72 urges plate 70 outwardly, against portion 68*a*. When the manual safety is in the operative or "on" or blocking position, as shown in FIG. 27 (and FIG. 2), the protrusion of embossed area 68*f* is resiliently engaged in opening 70*a* of plate 70, although opening 70*a* is obviously hidden by the protrusion of embossed area 68*f* in these views. When the user is ready to fire the pistol, pressure applied by the thumb on tab 68*d* causes lever 68 to rotate about the axis of circular portion 68*e* through angle z to the unblocked position of FIG. 28, where the protrusion of embossed area 68*f* resiliently engages opening 70*b* (again, not seen in FIG. 28 due to lever 68). Thus, the embossed areas or protrusions on the safety lever and the openings 70*a* and 70*b* in plate 70 provide detents resiliently defining the operative and inoperative positions of the safety lever, respectively. The protrusion on the inner side of embossed area 68*g* engages the surface of the frame and provides a friction drag during movement of safety lever 68.

After placing subassembly 64 in the space provided therefor in frame 42, the rear, cruciform portion of trigger bar 56*a* is placed upon trigger mechanism housing 66 in the usual manner. With the elements of the present invention provided and positioned as described, leg 56*b* of trigger bar 56*a* extends through open center 74*e* of trigger bar guide 74. As best seen in FIG. 27, side 74*b* of trigger bar guide 74 blocks rearward movement of trigger bar leg 56*b*, and shoulder 68*f* of safety lever 68 engages protrusion 74*g* on trigger bar guide 74 to block rearward movement thereof. Trigger bar 56*a* is connected to trigger 56 below the pivot point defined by circular portion 68*e*, whereby bar 56*a* must move rearwardly in order for trigger 56 to pivot rearwardly to fire the pistol. This requires, of course, manual movement of lever 68 to the position of FIG. 28, permitting rearward, sliding movement of trigger bar guide 74 as leg 56*b* moves rearwardly, together with the rest of trigger bar 56 in response to pulling the trigger. Engagement of angled protrusion 74*g* and shoulder 68*h* provides the desired resistance to movement of lever 68 from on (blocking) to off (unblocking), i.e., from the FIG. 27 to the FIG. 28 position. After firing, lever 68 must be manually moved back to the FIG. 27 (blocking) position.

In sum, trigger bar guide 74 constitutes a first member slidably movable between a first position that blocks movement of trigger bar 56, and a second position that permits movement of trigger bar 56. Lever 68 constitutes a second member pivotally movable between a first position that includes a shoulder 68*h* that engages protrusion 74*g* to block movement of trigger bar guide 74, and a second position that permits movement of trigger bar guide 74.

It will be noted that the manual safety system of the invention does not interfere with normal operation of the slide. Thus, when the gun is cocked, the slide operates normally although the trigger bar is locked, preventing inadvertent firing. This provides the highly desirable protection against inadvertent discharge while loading or unloading the pistol, the time when most inadvertent discharges occur. It is also notable that after firing on an empty chamber, with the striker forward and trigger bar rearward, lever 68 cannot be moved from off (FIG. 28) to on (FIG. 27) until the gun is re-cocked to place a new round in the chamber.

What is claimed is:

1. A manual safety system for a linear striker fired semi-automatic or automatic pistol having a frame, a slide, a trigger mechanism housing, a trigger which is moved in a first direction to fire said pistol and a trigger bar attached to said trigger and movable therewith in said first direction along a predetermined path, said safety system comprising:

a) a first member movable between a first position, wherein said first member blocks movement of said trigger bar in said first direction along said predetermined path, thereby preventing movement of said trigger to fire said pistol, and a second position, wherein said first member permits movement of said trigger bar in said first direction along said predetermined path, thereby permitting movement of said trigger to fire said pistol;

b) a second member having a first portion movable between a blocking position, wherein said first portion prevents movement of said first member away from said first position toward said second position thereof, and an unblocking position, wherein said first portion permits movement of said first member away from said first position toward said second position thereof, and a second portion manually movable between first and second positions to effect movement of said first portion between said blocking and unblocking positions thereof, respectively; and c) wherein said first member is slidably and said second member is pivotally mounted to said trigger mechanism housing.

2. The safety system of claim 1 and further including detent means for resiliently retaining said second portion of said second member in said first and second positions thereon.

3. A manual safety system for a linear striker fired semi-automatic or automatic pistol having a frame, a slide, a trigger mechanism housing, a trigger movable to fire said pistol, a trigger bar slidingly movable upon said trigger mechanism housing between forward and rearward positions and linked to said trigger so that movement of said trigger to fire said pistol requires movement of said trigger bar from said forward to said rearward position, said safety system comprising:

a) a blocking member mounted to said trigger mechanism housing for linear movement between a blocking position, wherein said blocking member is positioned to prevent movement of said trigger bar away from said forward toward said rearward position thereof, and an unblocking position, wherein said blocking member is removed from said blocking position to permit movement of said trigger bar to said rearward position thereof, and thus of said trigger to fire said pistol; and b) a manually movable member mounted to said trigger mechanism housing and selectively, pivotally movable from a first position, wherein said manually moveable member retains said blocking member in said blocking position, to a second position, permitting movement of said blocking member to said unblocking position.

4. The safety system of claim 3 and further including a pressure plate mounted between said manually movable member and said trigger mechanism housing to urge said manually movable member away from said trigger mechanism housing and toward an inner surface of said frame.

5. The safety system of claim 4 and further including a spring mounted between said pressure plate and said trigger mechanism housing to urge said pressure plate toward said manually movable member.

6. The safety system of claim 5 and further including detent means for resiliently retaining said manually movable member in each of said first and second positions thereof.

7. The safety system of claim 6 wherein said detent means comprise cooperative, resilient engagement portions of said manually movable member and said pressure plate.

8. The safety system of claim 3 wherein said blocking member and said manually movable member include respective edge portions which are in mutual engagement when said blocking member is in said blocking position and said manually movable member is in said first position.

9. The safety system of claim 8 wherein said respective edge portions include oppositely directed angled portions retarding movement of said manually movable member away from said first position.

10. A manual safety system for a linear striker fired semi-automatic or automatic pistol having a frame, a slide, a trigger mechanism housing, a trigger which is moved in a first direction to fire said pistol and a trigger bar attached to said trigger and movable therewith in said first direction along a predetermined path, said safety system comprising:

a) a first member movable between a first position, wherein said first member blocks movement of said trigger bar in said first direction along said predetermined path, thereby preventing movement of said trigger to fire said pistol, and a second position, wherein said first member permits movement of said trigger bar in said first direction along said predetermined path, thereby permitting movement of said trigger to fire said pistol; and b) a second member having a first portion movable between a blocking position, wherein said first portion prevents movement of said first member away from said first position toward said second position thereof, and an unblocking position, wherein said first portion permits movement of said first member away from said first position toward said second position thereof, and a second portion comprising a tab extending laterally outwardly from said frame in a position for engagement by the thumb of a person holding said pistol in the right hand, and manually movable between first and second positions to effect movement of said first portion between said blocking and unblocking positions thereof, respectively.

11. The safety system of claim 10 wherein said first and second portions of said second member are substantially flat and lie in spaced, parallel planes, and said second member includes a third portion integrally joining said first and second portions.

12. The safety system of claim 11 and further including a slot in said pistol frame, said first and second portions of said second member being positioned inside and outside, respectively, said frame, and said third portion passing through said slot.

13. A manual safety system for a linear striker fired semi-automatic or automatic pistol having a frame, a slide, a trigger mechanism housing having a recess, a trigger which is moved in a first direction to fire said pistol and a trigger bar attached to said trigger and movable therewith in said first direction along a predetermined path, said safety system comprising:

a) a first member movable between a first position, wherein said first member blocks movement of said trigger bar in said first direction along said predetermined path, thereby preventing movement of said trigger to fire said pistol, and a second position, wherein said first member permits movement of said trigger bar in said first direction along said predetermined path, thereby permitting movement of said trigger to fire said pistol;

b) a second member having a first portion positioned in said recess and movable between a blocking position, wherein said first portion prevents movement of said first member away from said first position toward said second position thereof, and an unblocking position, wherein said first portion permits movement of said first member away from said first position toward said second position thereof, and a second portion manually movable between first and second positions to effect movement of said first portion between said blocking and unblocking positions thereof, respectively; and c) wherein said recess and said first portion of said second member include complimentary, circular peripheral portions providing said pivotal mounting of said second member upon said trigger mechanism housing.

14. The safety system of claim 13 wherein said trigger mechanism housing includes a linear slot and said first member includes a flange portion positioned in said slot for guiding the path of movement of said first member between said first and second positions thereof.

15. A manual safety system for a linear striker fired semi-automatic or automatic pistol having a frame, a slide, a trigger mechanism housing, a trigger which is moved in a first direction to fire said pistol and a trigger bar attached to said trigger and movable therewith in said first direction along a predetermined path, said safety system comprising:

a) a first member movable between a first position, wherein said first member blocks movement of said trigger bar in said first direction along said predetermined path, thereby preventing movement of said trigger to fire said pistol, and a second position, wherein said first member permits movement of said trigger bar in said first direction along said predetermined path, thereby permitting movement of said trigger to fire said pistol;

b) a second member having a first portion movable between a blocking position, wherein said first portion prevents movement of said first member away from said first position toward said second position thereof, and an unblocking position, wherein said first portion permits movement of said first member away from said first position toward said second position thereof, and a second portion manually movable between first and second positions to effect movement of said first portion between said blocking and unblocking positions thereof, respectively;

c) detent means for resiliently retaining said second portion of said second member in said first and second positions thereon; and d) a pressure plate positioned between said first portion of said second member and said trigger mechanism housing and urging said second member away from said trigger mechanism housing and toward the adjacent inside surface of said frame.

16. A manual safety system for a linear striker fired semi-automatic or automatic pistol having a frame, a slide, a trigger mechanism housing, a trigger movable to fire said pistol, a trigger bar slidingly movable upon said trigger mechanism housing between forward and rearward positions and linked to said trigger so that movement of said trigger to fire said pistol requires movement of said trigger bar from said forward to said rearward position, said safety system comprising:

a) a blocking member mounted to said trigger mechanism housing for movement between a blocking position, wherein said blocking member is positioned to prevent movement of said trigger bar away from said forward toward said rearward position thereof, and an unblocking position, wherein said blocking member is removed from said blocking position to permit movement of said trigger bar to said rearward position thereof, and thus of said trigger to fire said pistol;

b) a manually movable member mounted to said trigger mechanism housing and selectively movable from a first position, wherein said manually moveable member retains said blocking member in said blocking position, to a second position, permitting movement of said blocking member to said unblocking position;

c) wherein said blocking member and said manually movable member include respective edge portions which are in mutual engagement when said blocking member is in said blocking position and said manually movable member is in said first position, said respective edge portions including oppositely directed angled portions retarding movement of said manually movable member away from said first position; and d) friction drag means between said manually movable member and said frame for frictionally opposing movement of said manually movable member between said first and second positions thereof.

* * * * *